US005299857A

United States Patent [19]

Zanetis

[11] Patent Number: 5,299,857

[45] Date of Patent: Apr. 5, 1994

[54] REMOVABLE HYDRAULIC APPARATUS WITH ELECTRIC CONTROL FOR MULTIPLE POSITIONING HYDRAULIC CYLINDERS

[75] Inventor: C. Christopher Zanetis, Brownsburg, Ind.

[73] Assignee: Alitec Corporation, Brownsburg, Ind.

[21] Appl. No.: 75,340

[22] Filed: Jun. 10, 1993

Related U.S. Application Data

[63] Continuation of Ser. No. 781,700, Oct. 21, 1991, abandoned.

[51] Int. Cl.[5] ..... E01C 23/12; A01G 23/06

[52] U.S. Cl. ..... 299/39; 404/90; 111/101

[58] Field of Search ..... 299/39; 404/90; 37/2 R; 111/101

[56] References Cited

U.S. PATENT DOCUMENTS

| | | | |
|---|---|---|---|
| 3,713,234 | 1/1973 | Grover et al. | 111/101 |
| 4,271,611 | 6/1981 | Paul | 111/101 |
| 4,878,713 | 11/1989 | Zanetis | 299/39 |
| 4,999,935 | 3/1991 | Simi et al. | 37/236 |
| 5,135,287 | 8/1992 | Karnes | 299/39 |

OTHER PUBLICATIONS

DigTec AP 400 Series II Cold Planer Brochure. (undated).

HydraForce SV10-42 Solenoid Valve Specification Sheet. (undated).

HydraForce SV10-41 Solenoid Valve Specification Sheet. (undated).

Melroe Europe Publication, Bobcat Grader Specifications (undated).

*Primary Examiner*—David J. Bagnell

*Attorney, Agent, or Firm*—Baker & Daniels

[57] ABSTRACT

An attachment apparatus which can be detachably mounted to a self-propelled vehicle, such as a skid-steer front end loader. The apparatus includes a frame which can be attached to the lift arms of the front end loader, and an axially rotatable work implement. The work implement may be positioned in at least two dimensions with respect to the frame by hydraulic cylinders. Secondary hydraulic lines which extend from each of the hydraulic cylinders, and a primary hydraulic line are hydraulically joined by a manifold. Electrically actuated valves connected to the manifold selectively provide communication between the primary hydraulic line and one of the secondary hydraulic lines to thereby control movement of the apparatus in each of the available dimensions. The control system requires that only one set of hydraulic cables be connected to the hydraulic pressure source of the vehicle, which simplifies attachment and removal of the apparatus, and provides safer operation, and reduced manufacturing costs.

10 Claims, 4 Drawing Sheets

REMOVABLE HYDRAULIC APPARATUS WITH ELECTRIC CONTROL FOR MULTIPLE POSITIONING HYDRAULIC CYLINDERS

This is a continuation of application Ser. No. 07/781,700 filed Oct. 21, 1991, now abandoned.

FIELD OF THE INVENTION

This invention relates to removable hydraulic attachments for vehicles such as skid-steer loaders, and, in particular, to systems for controlling the hydraulic action of the attachments when mounted on a vehicle.

BACKGROUND OF THE INVENTION

Using a single vehicle with multiple removable attachment devices to perform a variety of ground working functions is more cost effective than using separate specialized machines for each function. Thus, several devices for attachment to a self-propelled vehicle, including cold planers and rock wheels, have been developed. These attachments are powered by connecting them to the vehicle's hydraulic power source.

Some cold planers, such as the AP 400 Series II offered by DigTec of Columbia, S.C., are capable of providing hydraulic control for side shift, depth and tilt adjustments. Each of these adjustments is controlled by separate hydraulic cylinders and hydraulic circuits. Thus, there are three separate hydraulic control mechanisms accessible to the operator to control such a cold planer. In the AP Series II by DigTec, three levers are provided outside the cab of the vehicle in front of the operator. This is undesirable as the operator must reach out from the protective confines of the cab to activate the controls. Furthermore, the presence of six (6) hydraulic cables, two for each positioning hydraulic cylinder, proximate the control levers increases the potential for injury to the operator from accidental rupture or contact with the cables, which can, under normal operation, reach temperatures of over 200 degrees Fahrenheit. Moreover, excessive time is required to connect and disconnect the six hydraulic cables from the vehicle each time a different attachment is mounted to the vehicle. Thus, it is desirable to provide a hydraulic control system for movement in many dimensions, such as tilt, side shift and depth, which reduces the potential for injury to the operator. The planer positioning hydraulic controls of the DigTec planer are also hand-actuated. Since both hands of an operator are usually occupied by the vehicle movement controls, the operator cannot simultaneously control the vehicle movement and adjust the position of the cold planer with the hydraulic positioning controls. Furthermore, it is desireable to limit the number of hydraulic systems or subsystems required to provide such control in order to reduce manufacturing cost and the number of parts that might break down.

The pavement planing machine disclosed in U.S. Pat. No. 4,878,713 has both tilt adjustment and a side shift adjustment for a cold planer which is mountable to a skid-steer front end loader. Control for both adjustments is accomplished by using a single hydraulic cylinder actuable by a foot pedal in the vehicle cab. However, this planing machine does not allow for hydraulic depth control of the machine, nor are multiple hydraulic cylinders operated by a single hydraulic circuit.

OBJECTS OF THE INVENTION

Accordingly, it is one object of the present invention to provide an attachment apparatus mountable to a self-propelled vehicle which is hydraulically positionable in more than one dimension with respect to the frame of the apparatus.

It is another object of the present invention to provide an attachment apparatus which is safe and easy to operate and which is easy to attach and to remove from a self-propelled vehicle.

It is another object of the present invention to provide an attachment apparatus for a self-propelled vehicle which is inexpensive to manufacture and which is constructed from a minimal number of parts.

SUMMARY OF THE INVENTION

The invention comprises an attachment apparatus which can be detachably mounted to a self-propelled vehicle, such as a skid-steer front end loader, and includes a frame and an axially rotatable work implement positionable in at least two dimensions with respect to the frame. The apparatus also includes a plurality of hydraulic cylinders which each provide a means for moving the rotatable work implement in one of the different dimensions with respect to the frame. Pairs of secondary hydraulic lines extending from each of the hydraulic cylinders and a pair of primary hydraulic lines, which originate at the vehicle's hydraulic power source, are hydraulically joined together by a manifold. Electrically actuated valves connected to the manifold selectively provide communication between the pair of primary hydraulic lines and one the pairs of secondary hydraulic lines to thereby control movement of the apparatus in each of the available dimensions. A switch in the vehicle cab controls which of the hydraulic cylinders will be connected to the primary hydraulic lines. The control system requires that only one set of hydraulic cables be connected to the hydraulic pressure source of the vehicle to thereby provide easy attachment and removal of the apparatus, and safer operation, while limiting manufacturing costs.

Detailed Description

Figure 1:
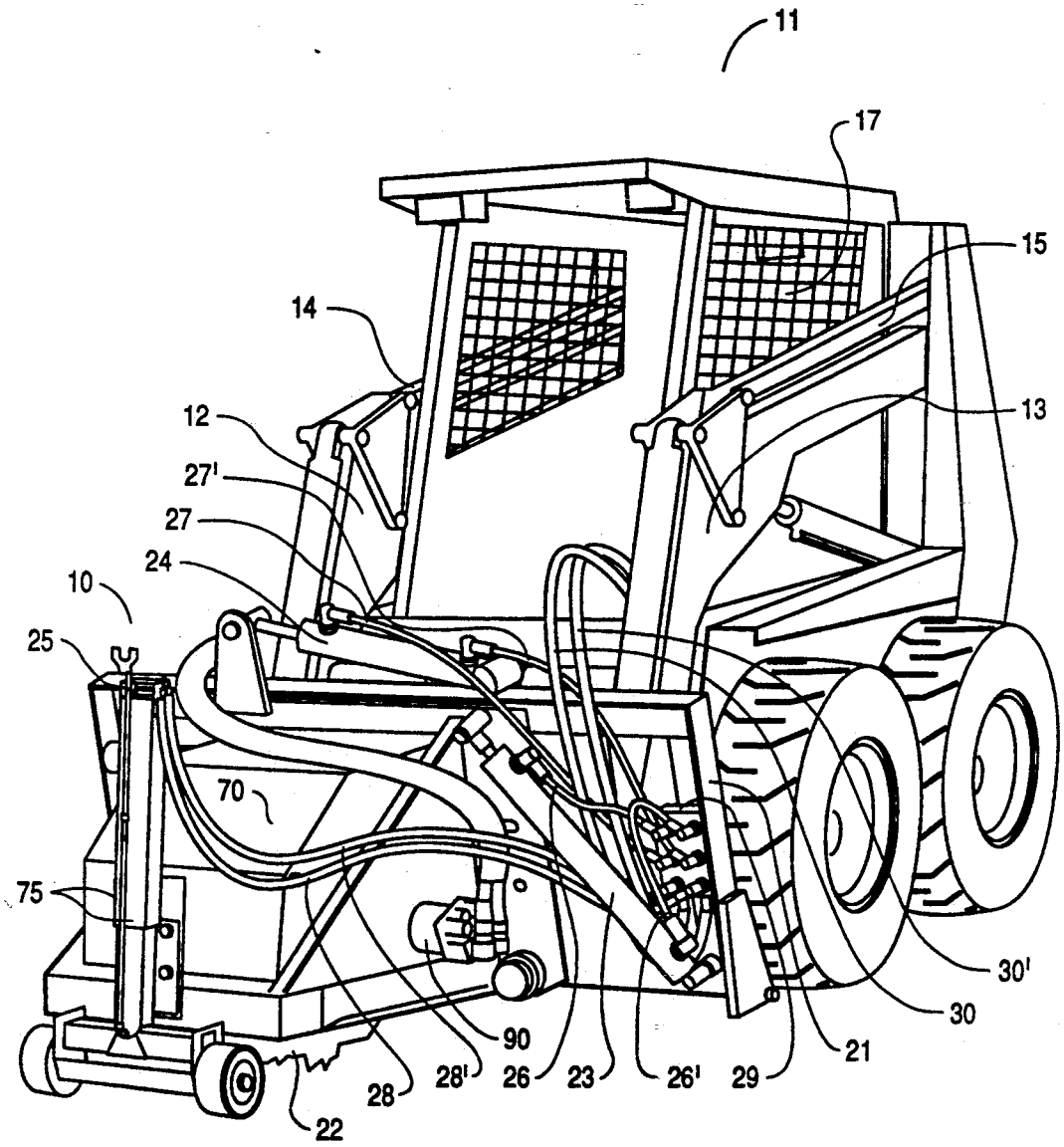
FIG. 1 shows a perspective view of the attachment apparatus of the present invention as it is mounted on a front end loader.

Referring now to FIG. 1, there is shown a perspective view of the attachment apparatus of the present invention as it is mounted on a front end loader. Cold planer 10 is mounted to self-propelled vehicle 11, such as the skid-steer front end loaders models 1840 or 1845C made by JI Case of Racine, Wis. As is conventional, loader 11 includes both an electrical power source and a hydraulic pressure source. Lift arms 12,13 each extend outwardly adjacent opposite sides 14,15, respectively, of loader 11 and are able to swing up and down in unison. Each lift arm 12,13 provides an attachment means 16 (see FIG. 2) which provides for the removable mounting of planer 10 to arms 12,13. Loader 11 also includes cab 17 from which an operator controls loader 11 and planer 10.

Cold planer 10 has means 20 (see FIG. 2) for attaching planer 10 to loader 11 by being mounted to lift arms 12,13. Such attachment means are well known in the art, and are described more fully in, for example, U.S. Pat. No. 4,878,713 which is incorporated herein by reference. In addition, planer 10 includes frame 21 and a ground engagable axially rotatable work implement 22. Work implement 22 is located in housing 70 and is positionable, with respect to frame 21, in several dimensions (see FIG. 2), and may be hydraulically powered by hydraulic motor 90.

It will be appreciated by those of skill in the art that the rotary device may comprise a rock wheel, or stump grinder, or other work implement.

Figure 2:
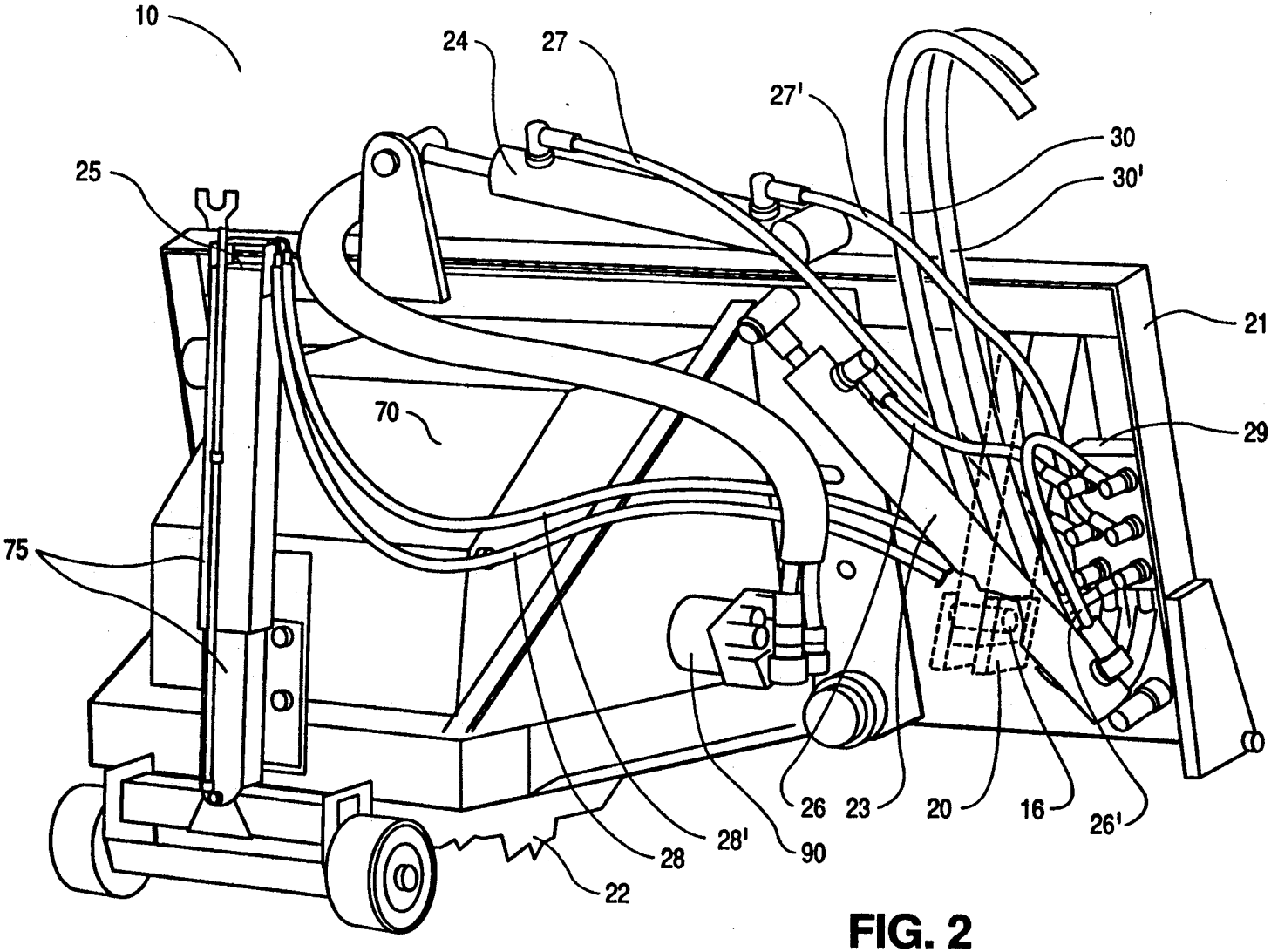
FIG. 2 shows a perspective view of the attachment apparatus of the present invention.

FIG. 2 shows a perspective view of the attachment apparatus of the present invention. Planer 10 includes hydraulic cylinders 23, 24 and 25 which provide a means for moving implement 22 in the side shifting, tilt and depth dimensions, respectively. Side shifting is the horizontal movement of housing 70 with respect to frame 21 and depth refers to the vertical movement of housing 70 with respect to the ground. Cylinder 25 is positioned within telescoping housing 75. Tilt refers to the ability of housing 70 to pivot with respect to frame 21 about a horizontal axis perpendicular to the rotary axis of implement 22. Connected to cylinders 23, 24 and 25 are pairs of secondary hydraulic lines, or cables, 26,26', 27,27', and 28,28', respectively, which are in turn connected to manifold 29. Also connected to manifold 29 is a pair of primary hydraulic lines, or cables, 30,30'. Primary hydraulic lines 30,30' include fitting means 32, 32' (see FIG. 3) for connecting primary lines 30,30' to manifold 29.

It will be appreciated by those of skill in the art that the three pairs of secondary hydraulic lines 26,26', 27,27' and 28,28' are connected through manifold 29 to a single pair of primary hydraulic lines 30,30' which is in turn connected to the hydraulic pressure source of loader 11. Thus, the number of apparatus positioning hydraulic lines connectable to loader 11 has been reduced from six to two and, therefore, planar 10 is more easily attached to or removed from loader 11. Furthermore, the presence of only two hydraulic lines near cab 17 of loader 11 reduces the potential for injury to an operator within cab 17 from inadvertent rupture of or contact with hydraulic lines.

Figure 3:
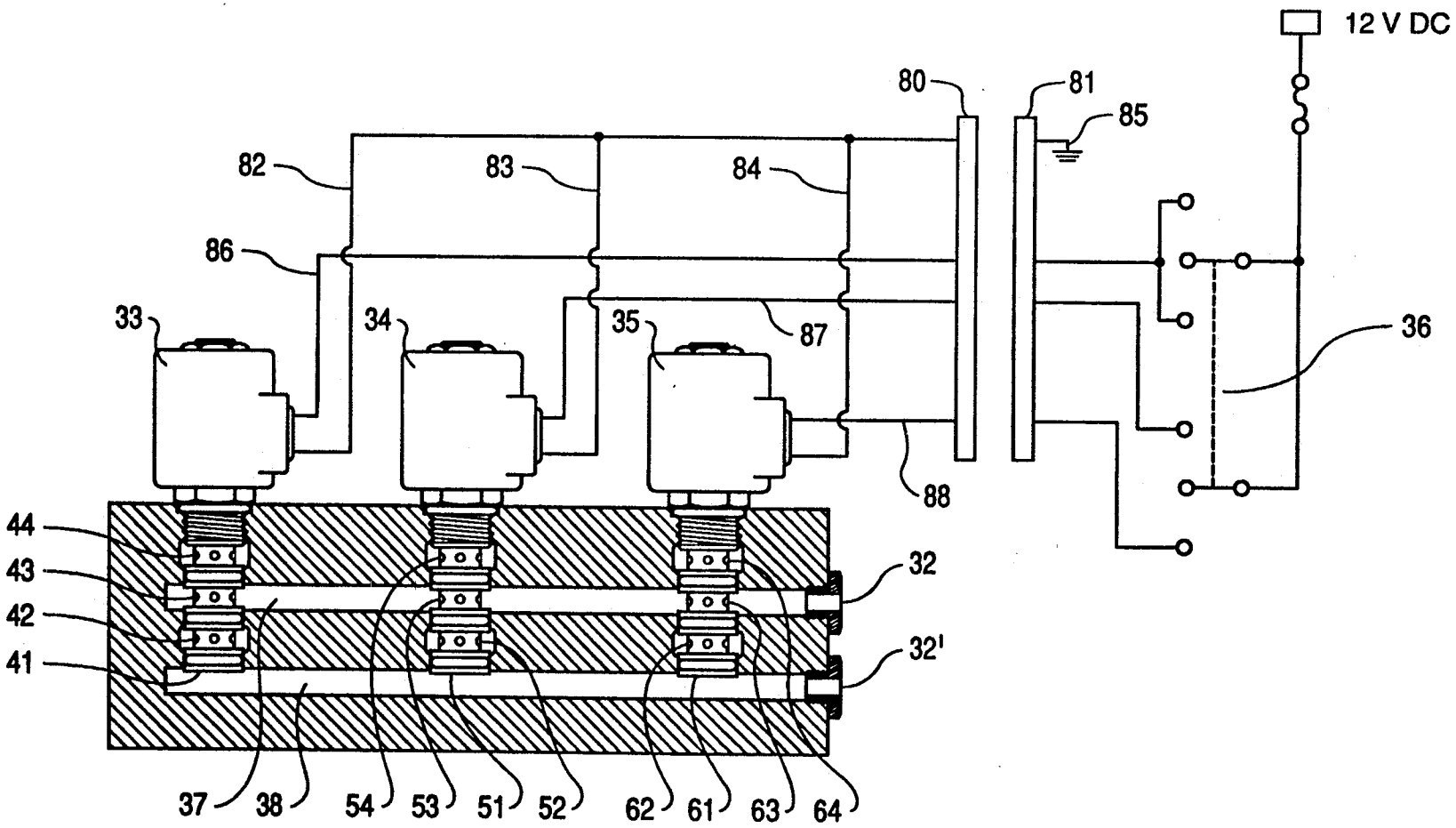
FIG. 3 shows a partial cross-sectional view of one embodiment of the manifold of the attachment apparatus of FIG. 2.

FIG. 3 shows a partial cross-sectional view of one embodiment of manifold 29 of the attachment apparatus of FIG. 2. Primary hydraulic lines 30,30' are connected to manifold 29 at ports 32,32'. Secondary hydraulic lines 26,26', 27,27' and 28,28' which control side shift, tilt and depth, respectively, communicate with electrically actuated valve means 33, 34, and 35, respectively. Specifically, side shift hydraulic lines 26 and 26' are connected to side shift valve ports 44 and 42, respectively; tilt hydraulic lines 27 and 27' are connected to tilt valve ports 54 and 52, respectively; and depth hydraulic lines 28 and 28' are connected to depth valve ports 64 and 62, respectively.

In this embodiment, valves 33, 34 and 35 are solenoid-operated, four-way, two-position, direct-acting, spool type, screw in hydraulic cartridge valves. Side shift valve 33, such as model SV10-42 available from HydraForce of Wheeling, Ill., is normally open, that is, flow is permitted from port 43 to port 44 as well as from port 42 to port 41. When side shift valve 33 is energized, flow is blocked between all side shift valve ports 41–44. Tilt valve 34 and depth valve 35, such as model SV10-41 available from HydraForce, are normally closed, that is flow is blocked between all tilt valve ports 51–54 and all depth valve ports 61–64, respectively. Thus, when valves 33, 34 and 35 are not energized as is the case when three-position electrical switch 36 is in the first open position, only side shift valve 33 is open and side shift secondary hydraulic lines 26 and 26' communicate through first and second manifold channels 37 and 38, respectively, to primary hydraulic lines 30 and 30' connected to manifold ports 32 and 32'. Similarly, if side shift valve 33 and tilt valve 34 are energized as is the case when switch 36 is in its second closed position, tilt secondary hydraulic lines 27 and 27' communicate through manifold channels 37 and 38 to primary hydraulic lines 30 and 30'. Finally, if switch 36 is in its third closed position meaning that both side shift valve 33 and depth valve 35 are energized, depth secondary hydraulic lines 28 and 28' communicate through manifold channels 37 and 38 to primary hydraulic valves 30 and 30'. Side shift, tilt and depth valves 33, 34, 35 are electrically connected to a double-pole three-position switch 36, located in cab 17 of loader 11. Specifically, first, second and third ground wires 82, 83, and 84, are joined at first connector 80 to which first, second and third conductors 86, 87 and 88 are also connected. First connector 80 is then joined with second connector 81 such that ground wires 82, 83, and 84 are grounded at common ground 85 and conductors 86, 87 and 88 are connected to switch 36 as shown. When switch 36, powered in this embodiment by a 12 volt DC source, is in its first open position, no current is supplied to side shift, tilt and depth valves 33, 34 and 35. When switch 36 is in its second closed position, electrical connection is made with first and second conductors 86 and 87 to thereby actuate side shift and tilt valves 33 and 34. When switch 36 is in its third closed position, electrical connection is made with first and third conductors 86 and 88 to thereby actuate side shift and depth valves 33 and 35.

In this embodiment, first connector 80 joins second connector 81 in such a manner so as to provide for easy electrical attachment and removal of planer 10 to front end loader 11. One wire harness, comprising the wires which originate at electrically actuated valves 33, 34 and 35 and first connector 80, extends from planer 10. A second wire harness, comprising the wires which originate at switch 36 within cab 17, common ground wire 85, and second connector 81, extends from loader 11. Thus, the electrical attachment and removal of planer 10 to loader 11 simply requires the connection and disconnection, respectively, of connectors 80 and 81.

Figure 4:
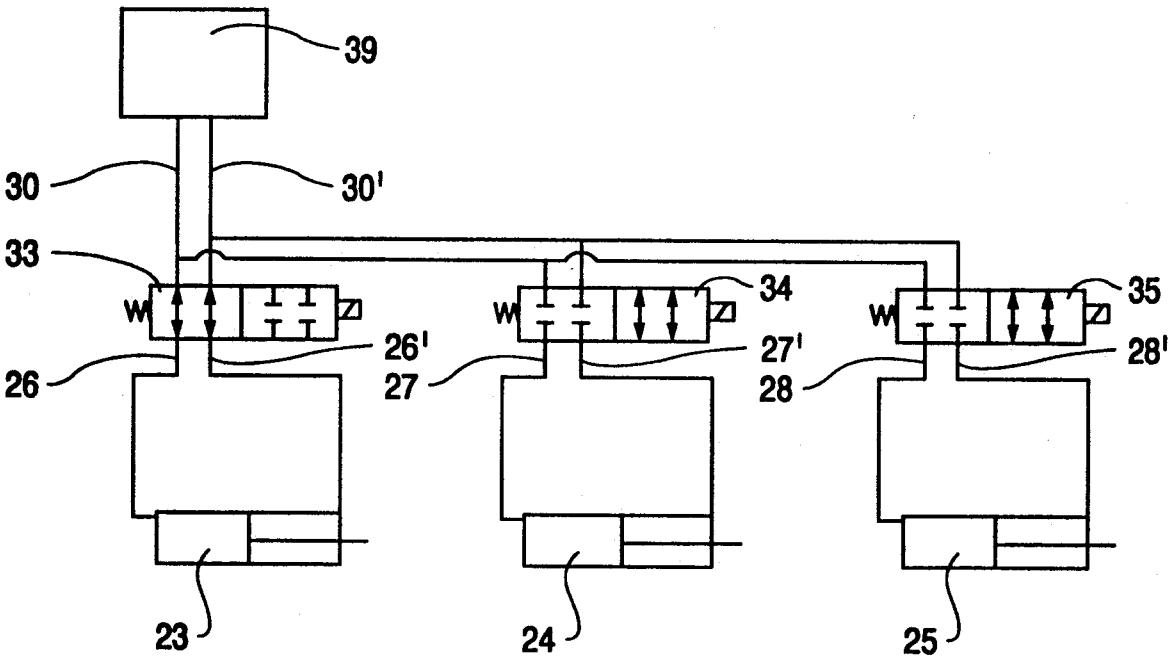
FIG. 4 shows a schematic of the hydraulic control circuit of the attachment apparatus of FIG. 2.

Referring now to FIG. 4, there is shown a schematic of one embodiment of the hydraulic control circuit of the attachment apparatus of FIG. 2. When switch 36 is in the first open position (valves 33, 34 and 35 are not energized), side shift valve 33 is open and tilt and depth valves 34 and 35 are closed. In this state, the operator is able to adjust the side shift position of apparatus 10. To adjust the tilt position, switch 36 is moved to its second closed position in which side shift and tilt valves 33 and 34 are energized. In this state, side shift valve 33 is closed, tilt valve 34 is open, and depth valve 35 is closed. To adjust the depth of apparatus 10, switch 36 is moved to its third closed position in which side shift and depth valves 33 and 35 are energized. Side shift and tilt valves 33 and 34 are closed, and depth valve 35 is open in this state.

During the operation of the attachment apparatus of the present invention, depth control is most often required while the self-propelled vehicle is in motion. Thus, the operator may adjust the side shift and tilt positions as required for the surface to be planed, and then adjust the depth during operation of the vehicle.

It will be appreciated by those of skill in the art that the degree and speed at which the each of hydraulic cylinders 23, 24 and 25 may be controlled by various mechanisms well known in the art. For example, means 39 for controlling the flow of hydraulic fluid with primary hydraulic lines 30, 30' may include a foot pedal located in cab 17 of vehicle 11. For proportional control of the hydraulic flow, the rate of depression of the foot pedal and the actual position of the foot pedal will control the rate of change in position and the actual position of the dimension being adjusted as indicated by the position of switch 36. This allows the operator, under normal operating conditions, to adjust one dimension, such as depth, while keeping his hands available for the control of other functions made available within cab 17 of loader 11.

It will be further appreciated that the number of hydraulic functions controlled in the present invention is not restricted to the embodiment shown herein. Conceptually, as few as two functions may be controlled, and more than three hydraulic cylinders may also be controlled using the control technique disclosed herein. It will also be appreciated that the control may be used with an apparatus which is not detachable, but rather is permanently affixed to the self-propelled vehicle.

It will also be appreciated that the control system is not limited to scalar movements. Through the implementation of a multi-position switch, a single switch position may correspond to the movement of one or more hydraulic cylinders to result in vector movement of the apparatus. It will further be appreciated that the work implement need not necessarily be rotatable. For example, a tree spade positionable by multiple hydraulic cylinders is within the scope and spirit of the invention, even though a tree spade is not normally considered to be a rotatable work implement.

I claim:

1. An attachment apparatus detachably mountable to a self-propelled vehicle, the vehicle comprising an electrical power source, a hydraulic pressure source, a pair of opposing lift arms each outwardly adjacent to one of a pair of opposite sides of the vehicle, said arms being swingable up and down in unison, and each of the lift arms comprising attachment means providing for removable mounting of the apparatus to the arms, the apparatus comprising:

a frame, means for attaching the apparatus to the lift arms, an axially revolvable work implement positionable in at least two dimensions with respect to the frame, said work implement continuously revolving during performance of work operations, means for hydraulically powering the revolution of the work implement, said powering means comprising at least one hydraulic motor and motor input and motor output hydraulic fluid lines, a plurality of hydraulic means for moving the work implement, each hydraulic means for moving the work implement providing movement of the revolvable work implement in one of the different dimensions with respect to the frame, and each hydraulic means for moving the work implement having at least one secondary hydraulic line extending therefrom, at least one primary hydraulic line, each primary hydraulic line comprising connection means to the hydraulic pressure source of the self-propelled vehicle, and electrically actuated valve means connected to the at least one primary hydraulic line and each of the at least one secondary hydraulic lines, the valve means selectively providing communication between the at least one primary hydraulic line and one of the at least one secondary hydraulic lines, the valve means comprising means for providing an electrical connection to the electrical power source of the self-propelled vehicle.

2. The attachment apparatus of claim 1 wherein the revolvable work implement comprises a cold pavement planer.

3. The attachment apparatus of claim 1 wherein the revolvable work implement is movable in the vertical and horizontal dimensions, and is pivotable, with respect to the frame.

4. The attachment apparatus of claim 1 wherein the electrically actuated valve means comprises a solenoid valve.

5. The attachment apparatus of claim 1, wherein the means for moving the work implement further comprises at least one hydraulic cylinder.

6. The attachment apparatus of claim 5, wherein at least one of the hydraulic cylinders is connected between the frame and the revolvable work implement.

7. The attachment apparatus of claim 5, wherein the at least one primary hydraulic line further comprises a pair of primary hydraulic lines, and wherein each at least one secondary hydraulic line further comprises a pair of secondary hydraulic lines.

8. The attachment apparatus of claim 7 further comprising a manifold to which the primary hydraulic lines, the secondary hydraulic lines, and the electrically actuated valve means are connected.

9. The attachment apparatus of claim 1, wherein the at least one primary hydraulic line further comprises a pair of primary hydraulic lines, and wherein each at least one secondary hydraulic line further comprises a pair of secondary hydraulic lines.

10. The attachment apparatus of claim 9, wherein the means for moving the work implement further comprises at least one hydraulic cylinder.

* * * * *